United States Patent [19]

Blick, III et al.

[11] 4,065,885

[45] Jan. 3, 1978

[54] PORTABLE BUILDING STRUCTURE

[75] Inventors: John S. Blick, III; Ralph N. Fuller, both of Laguna Beach, Calif.

[73] Assignee: Monogram Industries, Inc., Santa Monica, Calif.

[21] Appl. No.: 438,877

[22] Filed: Feb. 1, 1974

Related U.S. Application Data

[63] Continuation-in-part of Ser. No. 279,098, Aug. 9, 1972, abandoned.

[51] Int. Cl.[2] ..... E04B 1/348

[52] U.S. Cl. ..... 52/143; 52/264; 52/282

[58] Field of Search ..... 52/264, 280, 281, 282, 52/143

[56] References Cited

U.S. PATENT DOCUMENTS

| | | | |
|---|---|---|---|
| 1,539,537 | 5/1925 | Bates | 52/280 |
| 1,857,913 | 5/1932 | Sadelson | 52/264 |
| 2,364,083 | 12/1944 | Lindsay | 52/280 |
| 2,838,592 | 6/1958 | Feketics | 52/282 |
| 2,956,705 | 10/1960 | Clingman | 52/280 |
| 3,046,614 | 7/1962 | Sherron | 52/280 |
| 3,105,271 | 10/1963 | Sherron | 52/282 |
| 3,380,768 | 4/1968 | Wolfensberger | 52/282 |
| 3,492,767 | 2/1970 | Pincas | 52/143 |
| 3,688,458 | 9/1972 | Inman | 52/280 |

FOREIGN PATENT DOCUMENTS

| | | | |
|---|---|---|---|
| 58,142 | 9/1913 | Austria | 52/281 |
| 1,071,700 | 6/1967 | United Kingdom | 52/280 |

*Primary Examiner*—Price C. Faw, Jr.
*Assistant Examiner*—Henry Raduazo
*Attorney, Agent, or Firm*—Poms, Smith, Lande & Glenny

[57] ABSTRACT

A portable building structure, wherein a floor section supports corner posts which receive wall panels, the corner posts supporting a ceiling structure. Within the building structure is a portable toilet and a vent pipe extends upwardly through the ceiling structure. The floor structure, corner posts and ceiling structure are readily separable to render the building structure portable.

4 Claims, 10 Drawing Figures

PORTABLE BUILDING STRUCTURE

This application is a continuation-in-part of our pending application Ser. No. 279,098, filed Aug. 9, 1972, now abandoned.

BACKGROUND OF THE INVENTION

Building structures adapted to be transportable from place to place and commonly employed as a sanitary or toilet facility and for other purposes such as ticket booths, guard houses and the like, are well known.

For example, at construction sites, beaches, public meeting places or the like where sanitary facilities, ticket booths, guard houses or the like are not permanently installed, it is necessary that such building structures be transported onto the site for temporary use and later transported from the site. Typically, such building structures are heavy, bulky, difficult to transport, and in the case of toilet facilities, they are often unsanitary in that effective cleaning is difficult, if not impossible. Efforts have been made to enhance the portability of such building structures, but, nevertheless, it is typical that only a small number of the building structures can be transported by trucks or other vehicles, without resorting to substantial expense in time and effort to disassemble the building structure, either wholely or partially. The problems have persisted even though the need for portable facilities or buildings for housing sanitary facilities for selling tickets, or for providing shelter for guards has increased significantly through the years.

SUMMARY OF THE INVENTION

The present invention provides a novel portable building structure which is inexpensive to manufacture and which is composed of relatively few components. The components separately interfit with one another so that the building structure may be transported in a knocked-down, compact form, and at any desired location, the building structure may be erected quickly without substantial labor, and correspondingly, later knocked-down for transfer to another location.

More particularly, the invention provides a portable building structure wherein the frame may be composed of elongated extrusions cut to suitable lengths and corresponding forms for providing, when assembled with flooring, a base or floor structure which is adapted to receive upright corner members so constructed as to accomodate suitable side wall panels. When the corner posts and the side wall panels are erected, a ceiling structure composed of components generally similar to the floor, is placed upon the corner posts, thereby interlocking the assembly together. The side wall panels may vary depending upon the intended utility of the portable building structure. Thus, the side wall panels may be provided with, or have incorporated therein, various ventilators, windows or doors.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense, since the scope of the invention is best defined by the appended claims.

DESCRIPTION OF PREFERRED EMBODIMENT

Figure 1:
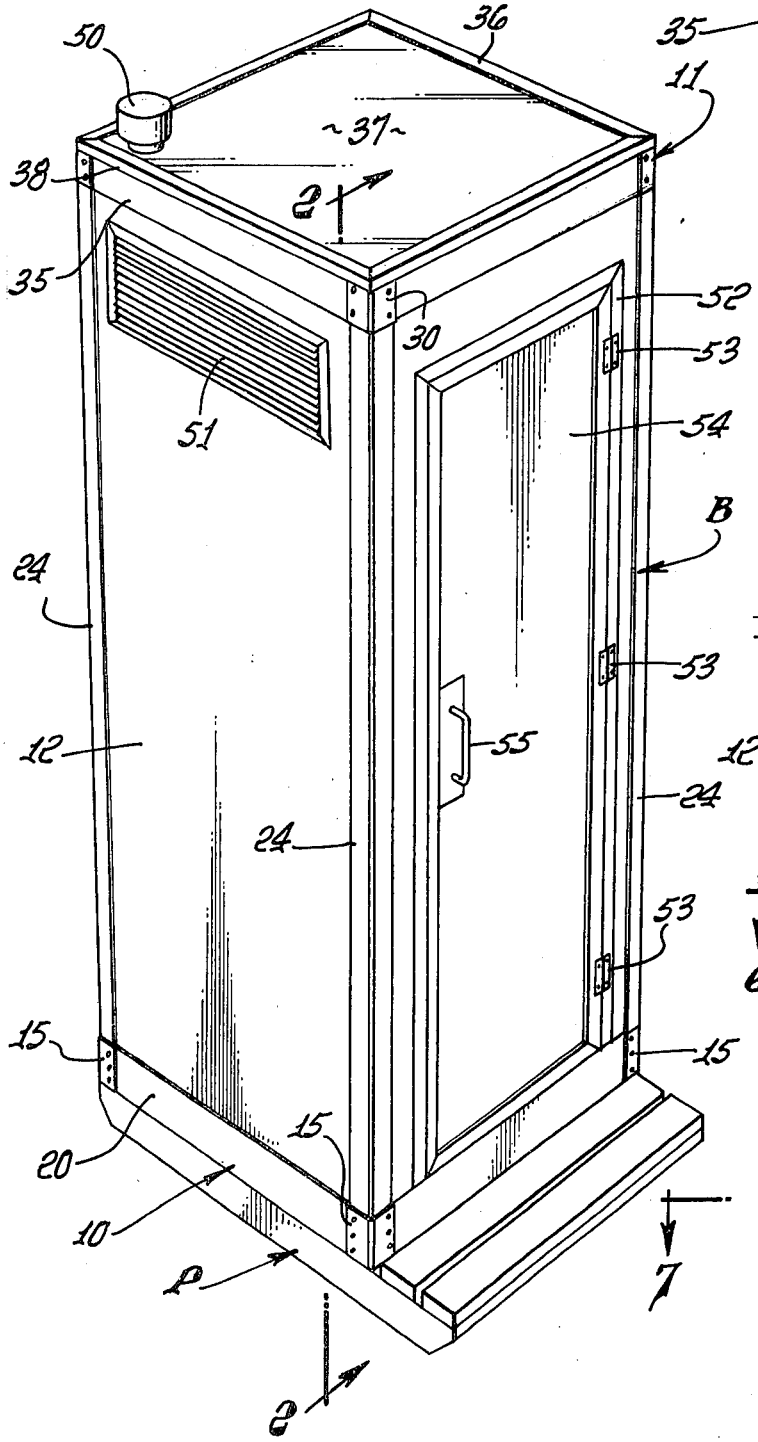
FIG. 1 is a perspective of the portable sanitary facility incorporating the invention.

Referring to the drawings, the invention is shown as being incorporated in a portable building structure B of the type employed to house a toilet T, such as typical chemical toilet, for example. The building B has a base or floor structure 10, adapted to be mounted in a pallet P, a ceiling or roof structure 11, side walls 12, 12, a rear wall 13, and a front wall 14, all of which are adapted to be quickly and conveniently assembled and disassembled, without requiring skilled labor or special tools.

Figure 2:
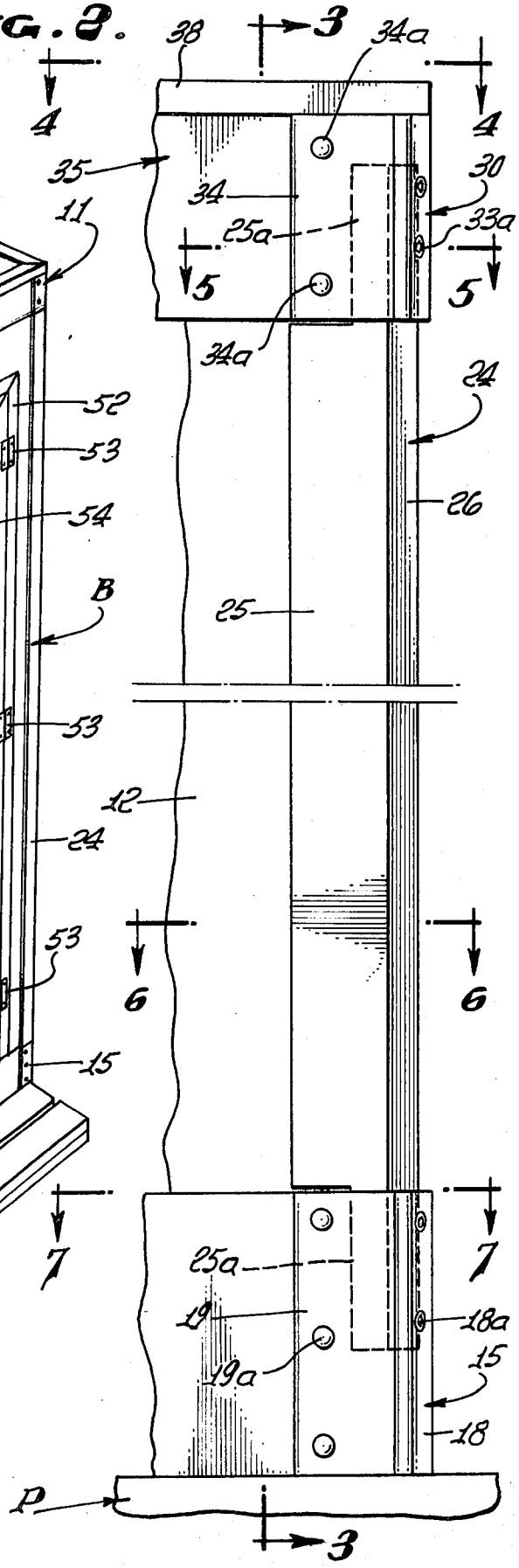
FIG. 2 is an enlarged fragmentary view, partly in elevation with parts broken away, and showing a typical connection between the elements of the building structure as taken generally on the line 2—2 of FIG. 1.
Figure 3:
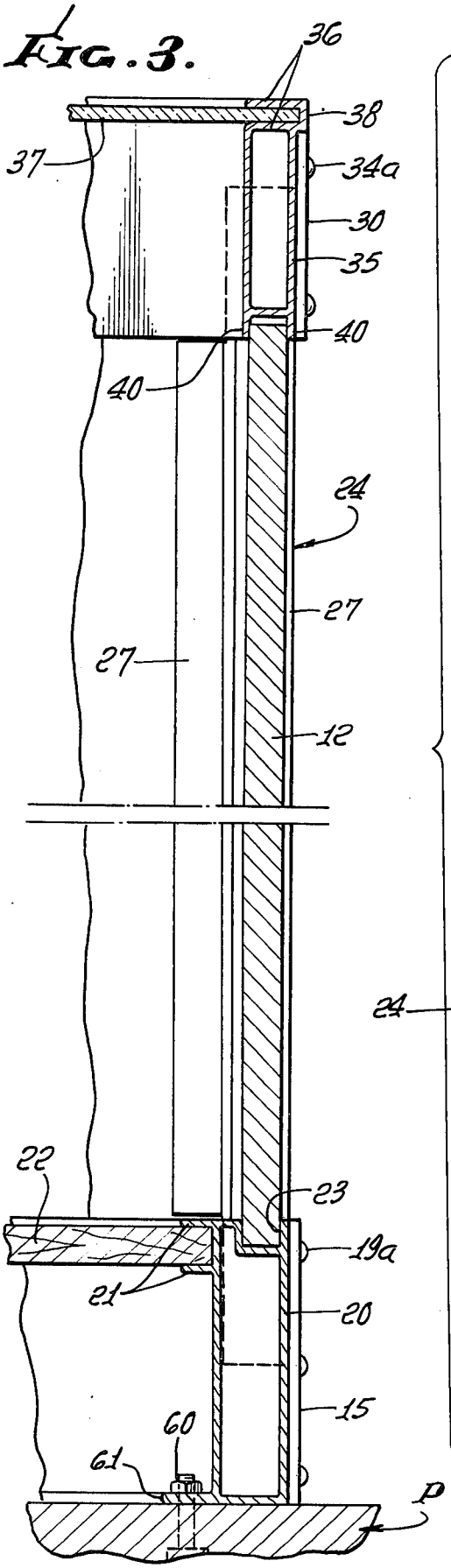
FIG. 3 is a view in vertical section, as taken on the line 3—3 of FIG. 2.
Figure 7:
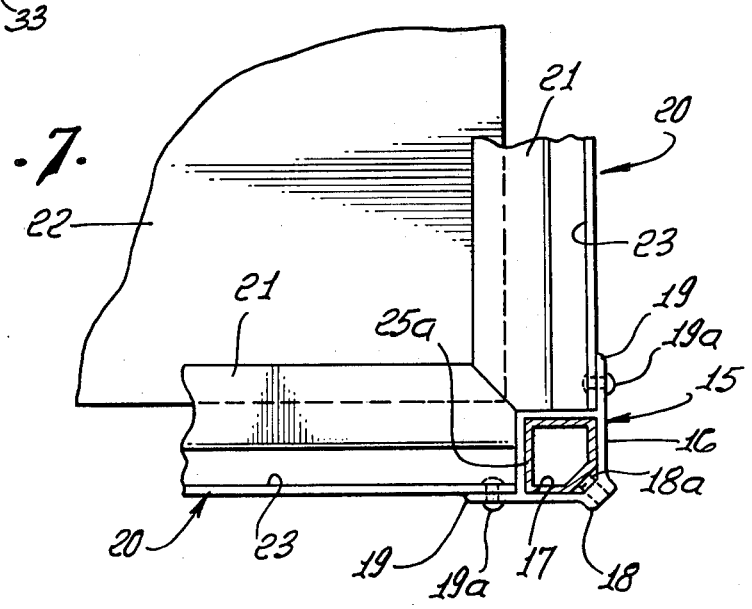
FIG. 7 is a fragmentary detail view in horizontal section, as taken on line 7—7 of FIG. 2.
Figure 9:
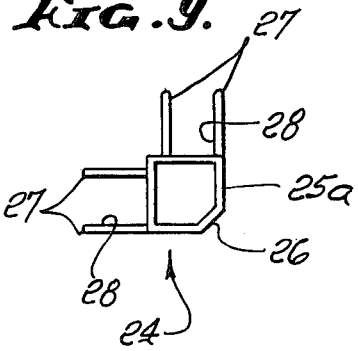
FIG. 9 is a fragmentary detail view in section, as taken on the line 9—9 of FIG. 8, showing a typical corner post.

As seen in FIGS. 2, 3, and 7, the base structure 10 is constructed of corner elements 15 which preferably consist, respectively, of corresponding sections of an elongated extrusion, say of aluminum. Each corner element 15 has a body section 16 having a socket 17 of generally rectangular configuration. In the illustrated form, the body 15 has an outer vertical rib 18. Projecting from the body 16 are side flanges 19 which are disposed at a right angle which includes the body 16. Extending horizontally between the corner members 15 and suitably affixed to the respective flanges 19, as by blind rivets **19*a*, are base frame members 20, which as seen in FIG. 3 are generally rectangular in section, but, if preferred, channel members may be employed. These frame members 20 have inwardly projecting, horizontally extended and vertically spaced flanges 21 adapted to receive a suitable flooring panel or flooring member 22. The flooring 22 is retained in place in the flanges 21 when the frame members 20 and the corner members 15 are interconnected as seen in FIG. 7. The frame members 20 have an upwardly opening channel 23 adapted to receive the respective side, rear and front walls, as will be later described. Thus, there is provided a floor structure which is unitized and which has at its respective four corners the sockets 17 adapted to receive vertical wall supporting corner posts respectively designated 24 which are adapted to be removably engaged in the socket 17, as will later be described, and to support the ceiling or roof structure 11**, as will also be later described.

Figure 6:
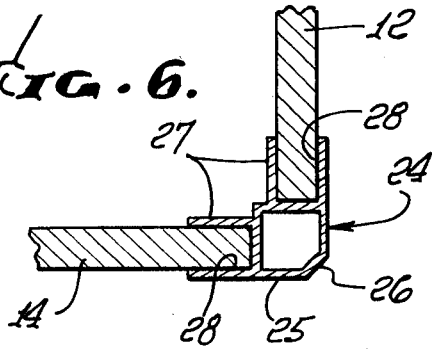
FIG. 6 is a fragmentary detail view in horizontal section, as taken on the line 6—6 of FIG. 2.

Referring to FIG. 6 it will be seen that each of the corner posts 24 has an intermediate elongated section between its upper and lower ends which consists of a body portion 25, having a beveled edge wall 26 to eliminate sharp corners, and having the integral with the body 25 channel sections or flanges 27 projecting laterally at a right angle including the body section 25 and providing grooves 28 adapted to receive the respective side, front and rear walls of the building structure, one of the side walls 12 and the front wall 14 being seen in FIG. 6. At the respective upper and lower ends of the corner posts 24 each of them has its channel sections or flanges 27 cut back longitudinally to expose end body portions 25*a*. The lower end body portion 25*a* of the respective corner posts 24 is adapted to fit into the socket 17 of one of the corner members 15 of the floor structure 10.

The respective wall panels 12, 13 and 14 are, as previously indicated, adapted to be received in the channels 28 of the corner posts 24, and the assembly procedure may involve placing a first corner post in one of the sockets 17, and then laterally installing one of the wall panels; thereafter installing the second corner post onto the exposed edge of the wall panel and slightly vertically spaced above the floor structure 10, whereupon the second corner post may then be lowered into its socket 17. This operation can be repeated through three of the wall panels, and the fourth wall panel may be either inserted vertically into the opposed slots 28 of the channel sections 27 of the corner post 24 or the opposing posts which support the fourth wall panel may be slightly spread apart to allow the fourth wall panel to be inserted there between. Suitable means such as set screws 18*a* threaded in the ridges 18 of the corner members 15 and engaged with the post sections 25*a*, are employed to retain the floor structure assembled.

Figure 8:
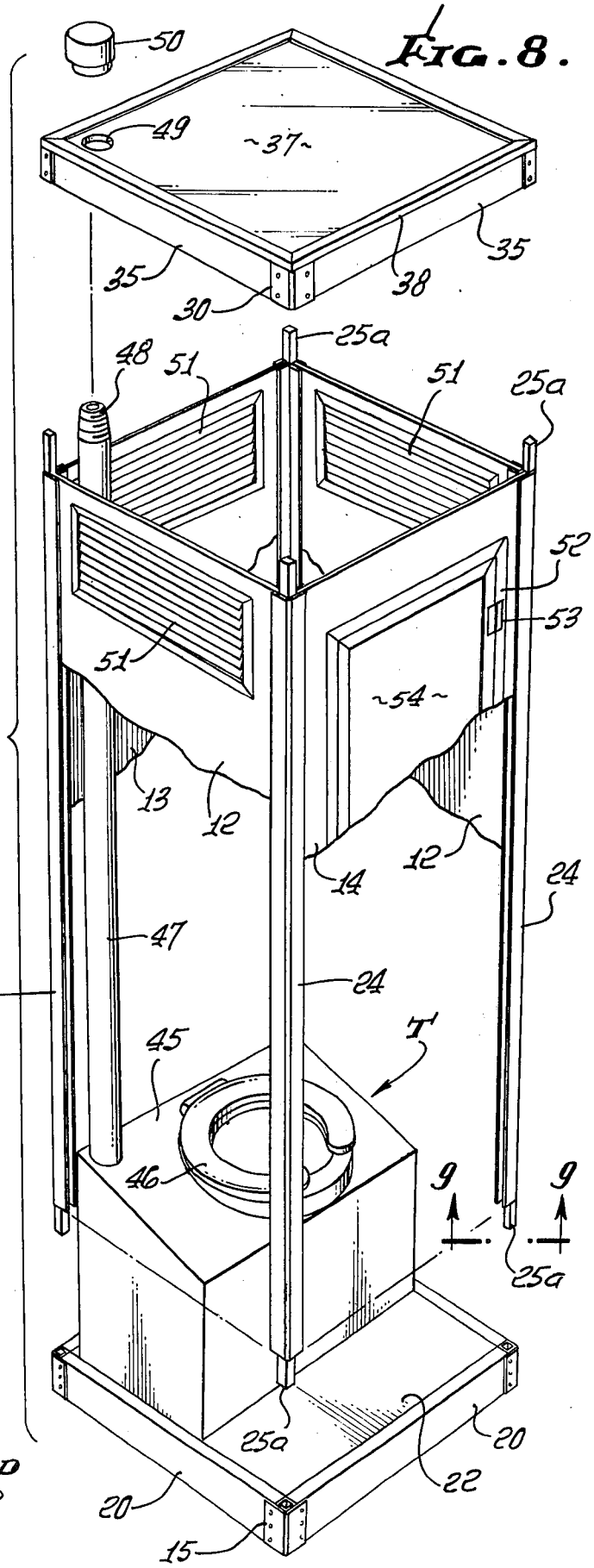
FIG. 8 is an exploded view in perspective illustrating the partially assembled building structure.
Figure 4:
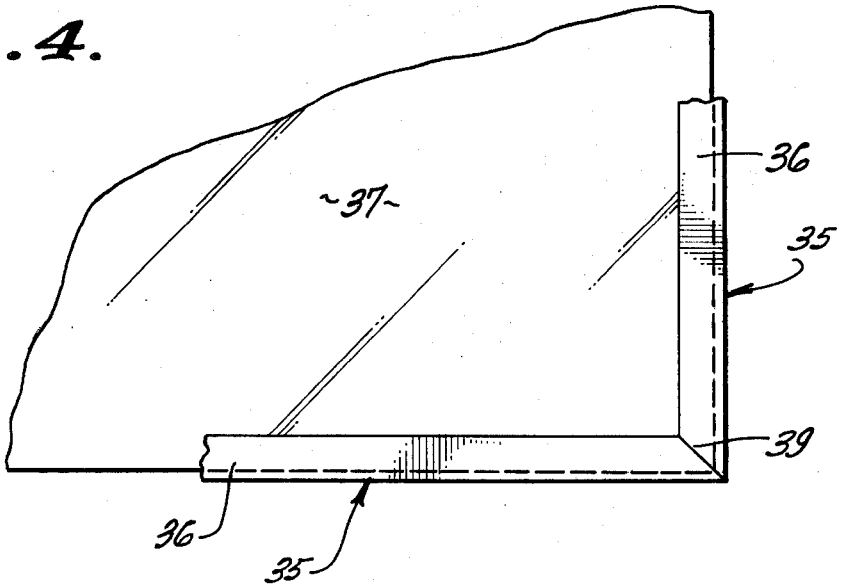
FIG. 4 is a fragmentary detail view in plan, as taken on the line 4—4 of FIG. 2.
Figure 5:
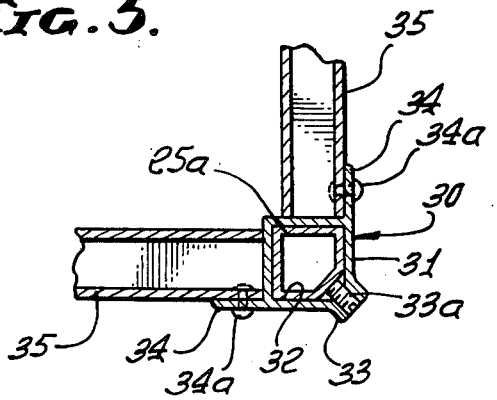
FIG. 5 is a fragmentary detail view in horizontal section, as taken on the line 5—5 of FIG. 2.

The roof structure 11, as best seen in FIGS. 4 and 5 consists of corner members 30 generally corresponding to the corner members 15 of the floor structure, and preferably made from the same extrusions. Thus, the corner members 30 each comprise a body section 31 providing a socket 32 adapted to receive an end portion 25*a* of the respective corner posts 24, and the outer ridge 33 is adapted to receive a locking screw 33*a* whereby the roof structure may be securely retained upon the corner posts 24 by the simple expedient of tightening the screws at the respective four corners. Projecting from the body section 31 of the upper corner members 30 are the right angularly related flanges 34 to which, as by rivets 34*a*, are secured horizontally extended rectangular roof supporting frame members 35, which like the lower supporting frame members 20 may be either of rectangular form or channel members providing at its upper edge, vertically spaced flanges 36 adapted to receive a ceiling panel 37, say of translucent plastic for an edge wall 38 interconnects the flanges 36 and is preferably spaced outwardly, as seen in FIG. 3, from the body of the frame member 35, so as to overly the corner members 30 at the mitered corners 39 of the ceiling frame members 35, as seen in FIG. 8.

The ceiling frame members 35 also have downwardly projecting, spaced flanges 40 forming a downwardly opening channels for receiving the upper edges of the respective walls 12, 13 and 14, when the assembled ceiling structure is placed upon the upper edges of the walls 12, 13 and 14 and the end portions 25*a* of the corner posts 24 are engaged in the sockets 32 in the respective corner members 30 of the roof structure 11.

The building B, as disclosed herein, is shown as a portable sanitary building containing the toilet T, the details of which are immaterial to the present invention. However, the toilet T comprises a suitable base 45 adapted to rest upon the floor panel 22, and having the usual toilet seat 46 hingedly mounted thereon. A vent pipe 47 extends upwardly from the base 45 and has an upper threaded end 48 adapted to extend through a complemental opening 49 in the ceiling panel 37 and to receive a vent cap 50, which, as seen in FIG. 1, is adapted to closely seat atop of the ceiling panel 37.

In addition, for ventilating the interior of the building structure B the respective side walls 12 and the rear wall 13 are each provided with suitable ventilator panels 51, such as the louvered panels shown herein, or if desired other forms of ventilatin means may be employed. In addition, the front wall 14, in the illustrative embodiment, includes a door frame 52, which, without need for specific illustrations herein, may consist of suitable channel members of extrusions cut to length to fit upon the front wall panel 14 on the edge of a door opening. Hingedly mounted at 53 within the door frame 52 is a door 54 having suitable pull 55 attached thereto. It will be appreciated that, as may be required by various regulation suitable latch means and spring means may be provided to normally loa the door 54 to a closed and latched position. Alternatively, again, without need of further specific illustration, it will be understood that various other door forms may be employed where, as for example, the portable building B is to be employed as a ticket booth, guard house or the like.

As is apparent from the foregoing, the present invention provides a portable building structure which may be conveniently erected or knocked down and the various components thereof may be of different porportions than herein illustrated. For example, the building herein illustrated is essentially square, but the building may be made wider or longer simply by extending the length of the extruded elements of the base frame members 20 and the ceiling frame members 35. In addition, if desired in the case of a relatively long building, intermediate post elements might be employed, where necessary, for rigidity. While the portable building structure B herein is shown as being disposed upon a pallet P such a pallet is not necessary in the event that the building is to be erected on firm ground, but such a pallet is desirable, say, where the portable building is to be mounted on soft or sandy soil so as to maintain the building in an upright condition, and to prevent the building from sinking into the soil. When desired, the base or floor structure 10 may be fastened to the pallet P by suitable fastenings 60, as seen in FIG. 3, which extend through a horizontally extended flange 61 formed on the base frame members 20.

Figure 10:
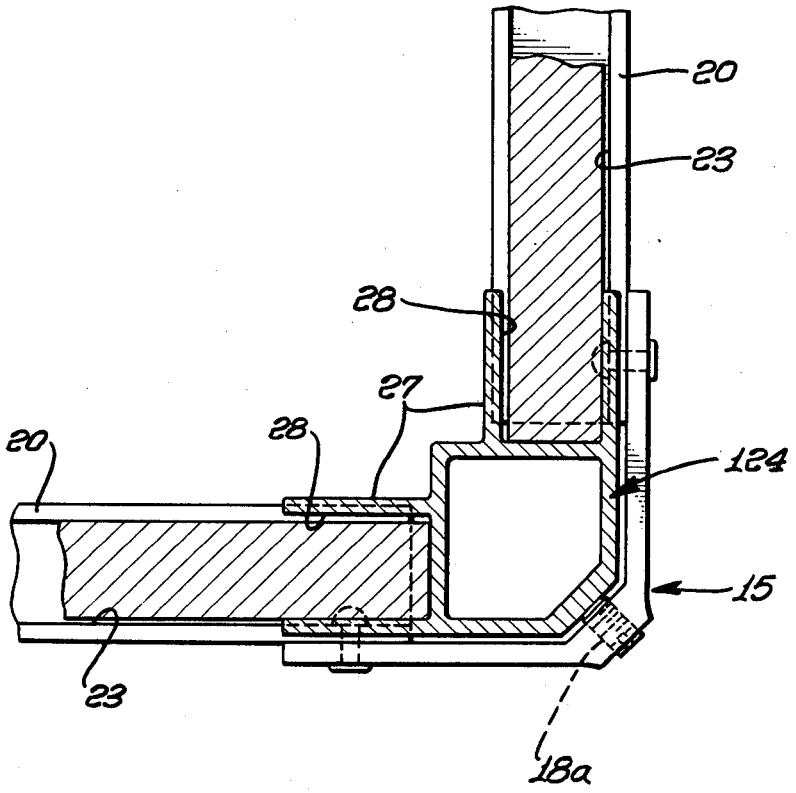
FIG. 10 is a fragmentary detail view of a representative corner assembly more particularly illustrating the clamping of the panels.

Referring to the structure of FIG. 10, the corner post 124 according to this embodiment is somewhat smaller than the socket in which it is received, so that when the set screws 18*a* force the corner post inwardly, a clamping of the panels results. When the panels forming the sides of the structure are disposed in the slots 28 of the channel section 27 of the corner post 24, with the lower edges of the panels extending downwardly into the upwardly opening channels 23 of the frame members 20 and extending upwardly into the downwardly opening channels formed by the flanges 40 of the frame members 35, the panels will be forced into frictionally locked engagement at their upper and lower edges by the action of the set screws 18*a* which force the corner posts 24 inwardly, whereby theouter flanges on the corner posts urge the panel edges against the inner flanges of the top and bottom frame members. It will be appreciated that while a lower corner is illustrated in FIG. 10, the corresponding structure employed in the upper corners will result in the clamping of the panels at the upper edges, and as a result of the panels being securely clamped against all of the horizontal rails, both top and bottom, under pressure applied by the outer vertical rails, the entire building structure is rendered more rigid.

We claim:

1. In a portable building comprising a base structure, a roof structure, side walls, a rear wall and a front wall having a door opening into the interior thereof, said base structure and said roof structure comprising frame members and a floor panel and a ceiling panel, respectively, each of said structures having means at the corners of said structures interconnecting said frame members, elongated corner posts of a unitary rigid non-resilient material, extending between the corners of said structures, means at the corners of said structures and on said corner posts removably connectable for interconnecting said corner posts and said structures said corner posts and said frame members having means for removably receiving wall panels in a close-fit relationship, and wall panels removably disposed between said corner posts, said means for removably receiving wall panels including elongated flanges on said corner posts and on said frame members forming panel receiving channels therebetween, said means at the corners of said structure and on said corner posts for interconnecting said corner posts and said structures comprising corner members having sockets at said corners and ends on said corner posts engaged in said sockets in said corner members, and means adjustably interlocking said corner members and said ends for forcing said flanges on said corner posts towards said flanges on said frame members for thereby gripping said panels firmly between said flanges to form a rigid self-supporting portable building, said means for adjustably interlocking also being adapted to selectively release said panels from said flanges to thereby quickly and easily dismantle said portable building.

2. In a portable building structure as defined in claim 1, said base frame members having means connectable to a pallet, and including an enlarged pallet beneath said building connected to said last mentioned means.

3. In a building structure as defined in claim 1, said corner members comprising sections of corresponding extrusions having a body and flanges extending at right angles from and including said body, and means connecting said flanges to said frame members.

4. In the portable building structure of claim 1 wherein said means for adjustably interlocking includes a threaded aperture in each corner member opening into each socket, and a screw threadably receivable in each threaded aperture having a distal end engagable with the ends of said corner posts in said sockets for bearing against said corner post ends when said screws are tightened for thereby forcing said flanges on said corner posts towards said flanges on said frames members.

* * * * *

UNITED STATES PATENT OFFICE

CERTIFICATE OF CORRECTION

Patent No. 4,065,885 Dated January 3, 1978

Inventor(s) John S. Blick, III, et al

It is certified that error appears in the above-identified patent and that said Letters Patent are hereby corrected as shown below:

The term of this patent subsequent to August 6, 1992 has been disclaimed.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*